US007707847B2

(12) United States Patent
Davis et al.

(10) Patent No.: US 7,707,847 B2
(45) Date of Patent: May 4, 2010

(54) ICE-DISPENSING ASSEMBLY MOUNTED WITHIN A REFRIGERATOR COMPARTMENT

(75) Inventors: Matthew William Davis, Louisville, KY (US); Alexander Pinkus Rafalovich, Louisville, KY (US); Mark Wayne Wilson, Simpsonville, KY (US); Gautam Subbarao, Louisvile, KY (US); Anil Kumar Tummala, Louisville, KY (US); Thiruvalan Venkatesan, Tamilnadu (IN); Anand Ganesh Joshi, Bangalore (IN); Hemachandran Umakanthan, Tamilnadu (IN); Sanjay Manohar Anikhindi, Bangalore (IN)

(73) Assignee: General Electric Company, Schenectady, NY (US)

( * ) Notice: Subject to any disclaimer, the term of this patent is extended or adjusted under 35 U.S.C. 154(b) by 204 days.

(21) Appl. No.: 11/290,733

(22) Filed: Nov. 30, 2005

(65) Prior Publication Data

US 2007/0119193 A1 May 31, 2007

(51) Int. Cl.
*F25C 5/18* (2006.01)

(52) U.S. Cl. ..... 62/344; 62/353; 222/542

(58) Field of Classification Search ..... 62/344, 62/353; 222/146.6, 542
See application file for complete search history.

(56) References Cited

U.S. PATENT DOCUMENTS 3,640,088 A * 2/1972 Jacobus et al. ..... 62/320
4,776,182 A 10/1988 Gidseg
5,096,095 A 3/1992 Burton
5,272,888 A 12/1993 Fisher et al.
5,375,432 A 12/1994 Cur
5,603,230 A 2/1997 Tsai
5,918,474 A 7/1999 Khanpara et al.
5,971,213 A 10/1999 Lee
6,351,955 B1 3/2002 Oltman et al.
6,438,988 B1 8/2002 Paskey
6,532,751 B1 3/2003 Schenk et al.
6,574,984 B1 6/2003 McCrea et al.
6,644,044 B2 11/2003 Kranz et al.
6,655,158 B1 12/2003 Wiseman et al.
6,732,537 B1 5/2004 Anell et al.
6,735,959 B1 5/2004 Najewicz
6,735,976 B2 5/2004 Lee
6,779,353 B2 8/2004 Hu et al.
6,817,195 B2 11/2004 Rafalovich et al.
6,945,068 B2 9/2005 Kim et al.

(Continued)

FOREIGN PATENT DOCUMENTS

WO WO 03/033976 A1 4/2003
WO WO 2004/085937 A1 10/2004

*Primary Examiner*—William E Tapolcai
(74) *Attorney, Agent, or Firm*—George L. Rideout, Esq.; Armstrong Teasdale LLP

(57) ABSTRACT

A refrigerator includes a housing having at least one refrigerator compartment, a door for accessing the at least one refrigerator compartment, and an ice-dispensing assembly. The ice-dispensing assembly includes an insulated housing arranged within the at least one refrigerator compartment, an ice-making device arranged within the insulated housing and configured to produce ice, an ice-storage container arranged within the insulated housing, and a dispenser arranged within the door and communicating with the ice-storage container, wherein the dispenser is configured to transfer ice from the ice-storage container to an external portion of the refrigerator.

18 Claims, 12 Drawing Sheets

U.S. PATENT DOCUMENTS

| | | | | |
|---|---|---|---|---|
| 6,964,177 | B2 | 11/2005 | Lee et al. | |
| 7,228,703 | B2 * | 6/2007 | Kim et al. | 62/353 |
| 7,266,972 | B2 * | 9/2007 | Anselmino et al. | 62/344 |
| 2004/0139759 | A1 | 7/2004 | Lee et al. | |
| 2004/0237563 | A1 | 12/2004 | Lee et al. | |
| 2004/0237565 | A1 | 12/2004 | Lee et al. | |
| 2004/0237569 | A1 | 12/2004 | Lee et al. | |
| 2004/0261442 | A1 | 12/2004 | Chung et al. | |
| 2005/0044874 | A1 | 3/2005 | Lee et al. | |
| 2005/0056043 | A1 | 3/2005 | Lee et al. | |
| 2005/0061017 | A1 | 3/2005 | Lee et al. | |
| 2005/0066670 | A1 | 3/2005 | Chung et al. | |
| 2005/0072166 | A1 | 4/2005 | Lee et al. | |
| 2005/0072167 | A1 | 4/2005 | Oh | |
| 2005/0072178 | A1 | 4/2005 | Park et al. | |
| 2005/0252232 | A1 | 11/2005 | Lee et al. | |

* cited by examiner

ICE-DISPENSING ASSEMBLY MOUNTED WITHIN A REFRIGERATOR COMPARTMENT

BACKGROUND OF THE INVENTION

This invention relates generally to an ice dispensing assembly, and more particularly, to an ice dispensing assembly mounted within a refrigerator compartment.

Known refrigerators generally include a refrigerator compartment and a freezer compartment. The freezer compartment often includes an ice-making apparatus. At least some known refrigerators include an ice-dispensing apparatus which can provide cubed or crushed ice through the door.

Through-the-door ice-dispensing apparatus are typically utilized in side-by-side or top mount refrigerators. An ice making system in the freezer compartment has a container for storing ice and a means for conveying ice cubes from the container to a downwardly facing discharge opening. The ice-dispensing apparatus typically includes a chute extending through the door which includes a dispenser opening for delivering ice to a user.

However, due to the positioning of the freezer compartment in bottom freezers, where the freezer compartment is located below the refrigerator compartment, it is inconvenient for a consumer to access ice within the freezer compartment. Additionally, the freezer compartment is positioned at an insufficient height for through-the-door dispensing.

BRIEF DESCRIPTION OF THE INVENTION

In one aspect, an ice-dispensing assembly is provided for a refrigerator having at least one refrigerator compartment and a door providing access to the refrigerator compartment. The ice-dispensing assembly includes an insulated housing arranged within the refrigerator compartment, an ice-making device arranged within the insulated housing, wherein the ice-making device is configured to produce ice. The ice-dispensing assembly also includes an ice-storage container arranged within the insulated housing.

In another aspect, a refrigerator is provided. The refrigerator includes a refrigerator body having at least one refrigerator compartment, a door for accessing the at least one refrigerator compartment, and an ice-dispensing assembly. The ice-dispensing assembly includes an insulated housing arranged within the at least one refrigerator compartment, an ice-making device arranged within the insulated housing and configured to produce ice, an ice-storage container arranged within the insulated housing, and a dispenser arranged within the door and communicating with the insulated housing, wherein the dispenser is configured to transfer ice from the insulated housing to an external portion of the refrigerator.

In still another aspect, a method of assembling a refrigerator is provided including providing a housing defining a refrigerator compartment and a freezer compartment, and coupling a freezer evaporator in flow communication with the freezer compartment. The method also includes providing an ice-dispensing assembly within the refrigerator compartment, wherein the ice dispensing assembly includes an ice-making device and an ice-dispensing assembly evaporator for cooling the ice-dispensing assembly. The method also includes providing a controller within the refrigerator, wherein the controller is configured to operate the freezer compartment in a normal mode of operation and a defrost mode of operation, and the controller is configured to operate the ice-dispensing assembly in a water-fill mode of operation, an ice-making mode of operation and a defrost mode of operation.

DETAILED DESCRIPTION OF THE INVENTION

Figure 1:
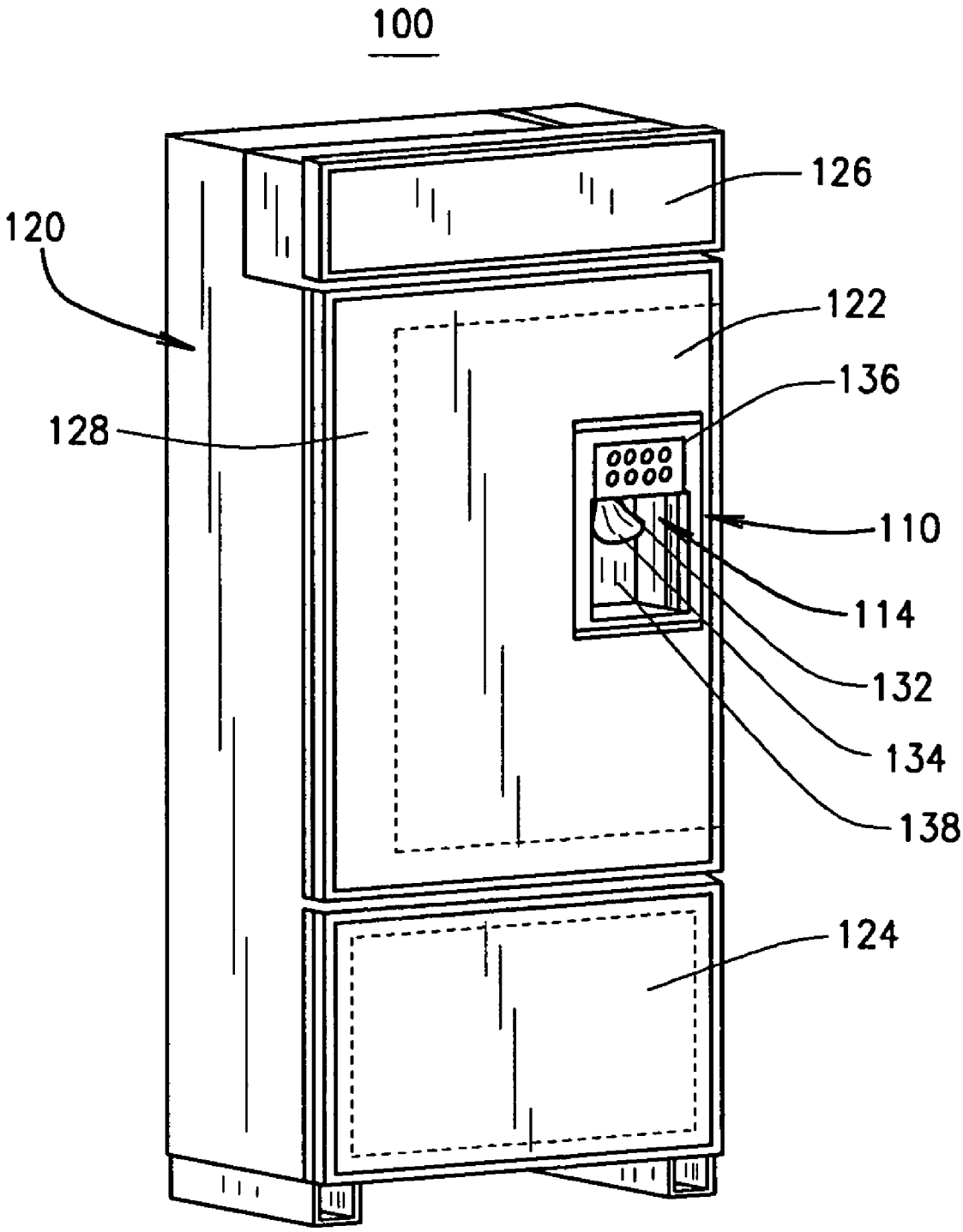
FIG. 1 is a perspective view of a refrigerator including an ice-dispensing assembly.

FIG. 1 is a perspective view of a refrigerator 100 including an ice-dispensing assembly 110 for dispensing water and/or ice. In the exemplary embodiment, ice-dispensing assembly 110 includes a dispenser 114 positioned on an exterior portion of refrigerator 100. Refrigerator 100 includes a housing 120 defining an upper refrigerator compartment 122 and a lower freezer compartment 124 arranged at the bottom of refrigerator 100. As such, refrigerator 100 is generally referred to as a bottom mount refrigerator. In the exemplary embodiment, housing 120 also defines a mechanical compartment 126 at the top of refrigerator 100. Mechanical compartment 126 receives a sealed cooling system (shown in FIG. 3). It is recognized, however, that the benefits of the present invention apply to other types of refrigerators. Consequently, the description set forth herein is for illustrative purposes only and is not intended to limit the invention in any aspect.

A refrigerator door 128 is rotatably hinged to an edge of housing 120 for accessing refrigerator compartment 122. A freezer door 130 is arranged below refrigerator door 128 for accessing freezer compartment 124. In the exemplary embodiment, freezer door 130 is rotatably coupled to housing 120. In another embodiment, freezer door 130 is coupled to a freezer drawer (not shown) slidably coupled within freezer compartment 124.

In the exemplary embodiment, dispenser 114 includes a discharging outlet 132 for accessing ice and water. A single paddle 134 is mounted below discharging outlet 132 for operating dispenser 114. A control panel 136 is provided for controlling the mode of operation. For example, control panel 136 includes a water dispensing button (not labeled) and an ice-dispensing button (not labeled) for selecting a desired mode of operation.

Discharging outlet 132 and paddle 134 are an external part of dispenser 114, and are mounted in a concave portion 138 defined in an outside surface of refrigerator door 128. Concave portion 138 is positioned at a predetermined elevation convenient for a user to access ice or water enabling the user to access ice without the need to bend-over, and without the need to access freezer compartment 124. In the exemplary embodiment, concave portion 138 is positioned at a level that approximates the chest level of a user.

Figure 2:
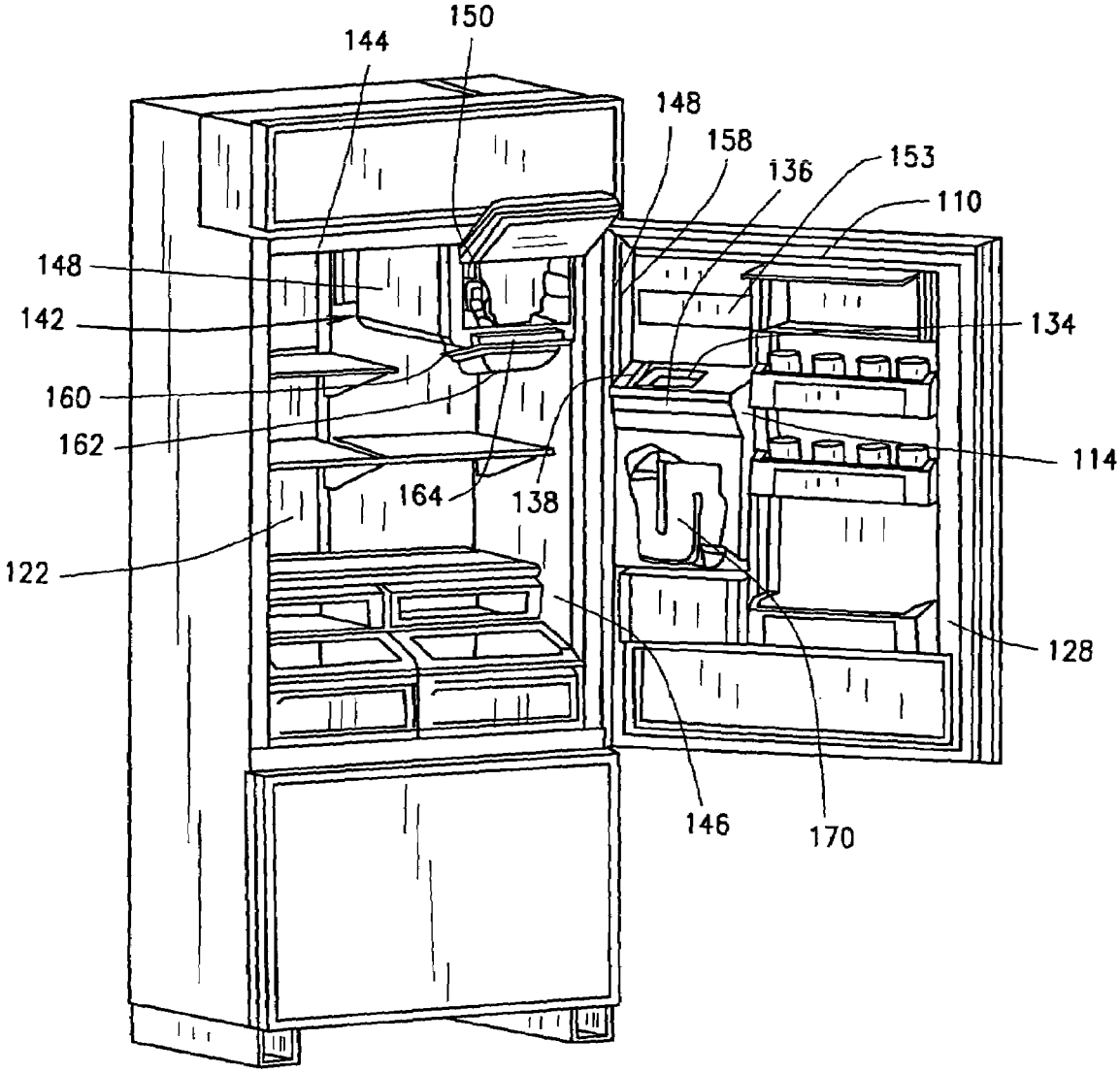
FIG. 2 is a perspective view of the refrigerator shown in FIG. 1, having a refrigerator door in an open position.

FIG. 2 is a perspective view of refrigerator 100 having door 128 in an open position. As such, the various components of ice dispensing assembly 100 are illustrated. Ice-dispensing assembly 110 includes an insulated housing 142 mounted within refrigerator compartment 122 along an upper surface 144 of compartment 122 and along a sidewall 146 of compartment 122. Insulated housing 142 includes insulated walls 148 defining an insulated cavity 150. Due to the insulation which encloses cavity 150, the temperature within the cavity can be maintained at levels different from the ambient temperature in the surrounding refrigerator compartment 122. In the exemplary embodiment, insulated cavity 150 is constructed and arranged to operate at a temperature to facilitate producing and storing ice. Alternatively, insulated housing 142 could be operated as a food storage compartment at higher or lower temperatures than that of the surrounding refrigerator compartment 122, to function for example as a quick chill or a quick thermo compartment.

Ice-dispensing assembly 110 includes dispenser 114 coupled to refrigerator door 128. As illustrated in FIG. 2, dispenser 114 is arranged within refrigerator door 128, and particularly, is arranged along an inner edge 148 of refrigerator door 128. Additionally, dispenser 114 is positioned a distance 152 from a top of refrigerator door 128. Distance 152 is variably selected to orient dispenser 114 with respect to insulated housing 142 when refrigerator door 128 is in a closed position. Specifically, as will be described in more detail below, dispenser 114 is positioned proximate to and vertically below a portion of insulated housing 142 when door 128 is in the closed position such that ice is delivered from insulated housing 142 into dispenser 114 and to a user. Moreover, in the exemplary embodiment, a refrigerator control panel 153 is coupled to an interior of the refrigerator door 128 generally vertically above dispenser 114. Specifically, control panel 153 partially fills the space above dispenser 114, and as such, more space is available in refrigerator compartment 122.

In the exemplary embodiment, dispenser 114 includes an inlet 154, an ice discharge conduit or chute 156, and a chute door 158 moveable between an open position and a closed position for passing ice therethrough. Chute 156 is in communication with inlet 154 and discharging outlet 132 outside refrigerator door 128 (shown in FIG. 1). In use, ice enters chute 156 through inlet 154 and is channeled through chute 156 to outlet 132 upon activation of paddle 134 (shown in FIG. 1). In the exemplary embodiment, chute door 158 is positioned at a bottom portion of chute 156, near first outlet 130 (shown in FIG. 1), and is opened upon activation of paddle 134. Ice entering chute 156 upon activation of paddle 134 is dispensed through chute door 158 and first outlet 130.

In the exemplary embodiment, an ice-storage container 160 is movably received in insulated housing 142. A discharge opening 162 is defined through the bottom of ice-storage container 160. Discharge opening 162 is substantially aligned and in communication with inlet 154 of the door mounted portion of ice-dispensing assembly 110. In the exemplary embodiment, discharge opening 162 includes an access door 164 moveable between an open position and closed position. When open, access door 164 provides access to ice-storage container 160 for discharging crushed or cubed ice from ice-storage container 160. As such, crushed or cubed ice produced and housed within insulated housing 142 is dispensed to an external portion of refrigerator 100 through discharge opening 162 and chute 156 of dispenser 114.

In the exemplary embodiment, dispenser 114 includes a water tank 170 for storing a predetermined amount of water therein. Water tank 170 is also in communication with discharging outlet 132 (shown in FIG. 1) such that water can be dispensed through refrigerator door 128.

Figure 3:
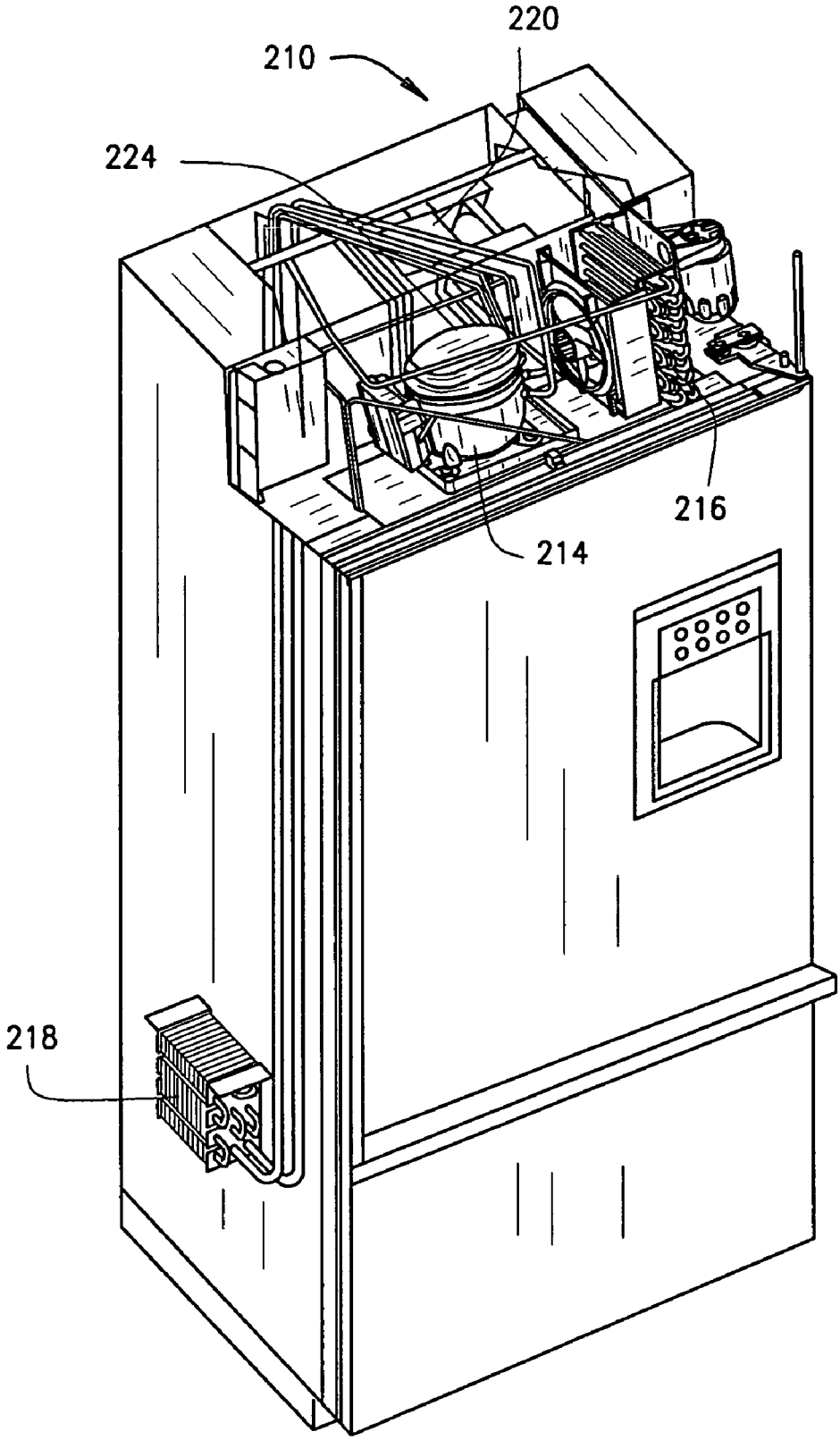
FIG. 3 is a partial cut-away view of the refrigerator shown in FIG. 1, illustrating an exemplary sealed cooling system therefor.

FIG. 3 is a partial cut-away view of the refrigerator shown in FIG. 1, illustrating the exemplary sealed cooling system 210 therefore. Sealed cooling system 210 has components for executing a known vapor compression cycle for cooling refrigerator 100. Such components include a compressor 214, a condenser 216, and a freezer evaporator 218 for producing cooling air for freezer compartment 124 (shown in FIG. 2). In the exemplary embodiment, the components also include a dedicated ice-dispensing assembly evaporator 220 for cooling insulated housing 142 (shown in FIGS. 2 and 4). Evaporators 218 and 220 are operated in series. Alternatively, evaporators 218 and 220 could be operated in parallel, or independently from one another. Alternatively, a third evaporator could be added to separately provide cooling to refrigerator compartment 122 directly. In the exemplary embodiment, each evaporator 218 and 220 includes a defrost heater 224. Each defrost heater 224 is operated independently.

Figure 4:
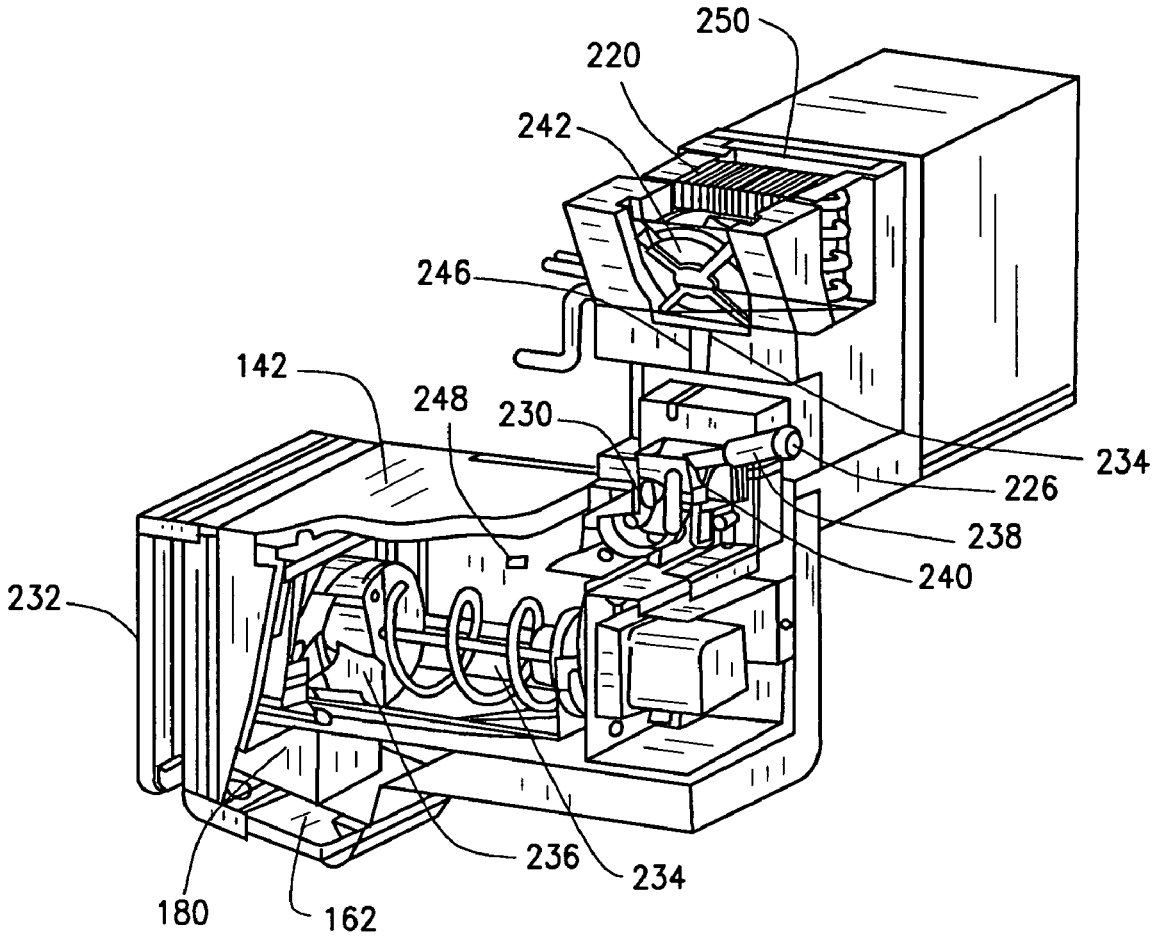
FIG. 4 is a schematic view of an insulated housing for use with the refrigerator shown in FIG. 1 and 2, and illustrating the sealed cooling system shown in FIG. 3.

FIG. 4 is a schematic view of the insulated housing for use with refrigerator 100 shown in FIGS. 1 and 2, and illustrating a portion of sealed cooling system 210 shown in FIG. 3. In the exemplary embodiment, insulated housing 142 has an ice maker 230 received therein, for making ice and dispensing the ice into ice storage container 160. Ice maker 230, in accordance with conventional ice makers, includes a number of electromechanical elements that manipulate a mold to shape ice as it freezes and a mechanism to remove or release frozen ice from the mold into ice-storage container 160. Periodically, the ice supply is replenished by ice maker 230 as ice is removed from ice-storage container 160. The storage capacity of container 160 is generally sufficient for normal use of refrigerator 100. In addition, a water tube 238 supplies water to ice maker 230 and a water sensor 240 senses each water fill into ice maker 230. In the exemplary embodiment, sensor 240 is coupled to a water valve 226 and a signal relating to a water fill is transmitted upon opening of valve 226.

An access door or cover 232 is positioned along a front edge of insulated housing 142 and is moveable for accessing insulated housing 142. In one embodiment, cover 232 is rotatably mounted to insulated housing 142 along, the upper edge thereof. Alternatively, cover 232 could be rotatably mounted along a side edge or slidably mounted to insulated housing 142. When cover 232 is opened, ice-storage container 160 is accessed. Each of the components of ice-dispensing assembly 110 function together to produce and deliver ice to a user. To facilitate maintaining a temperature to produce and/or store ice, cover 232 seals insulated housing 142 and substantially eliminates airflow between insulated housing 142 and refrigerator compartment 122 when cover 232 is closed.

In the exemplary embodiment, insulated housing 142 includes an auger system 234 for delivering ice to discharge opening 162 and a crusher mechanism 236 for crushing ice prior to delivery through discharge opening 162. Auger system 234 and crusher mechanism 236 are positioned within ice-storage container 160. Ice-storage container 160 is slidably received in insulated housing 142. By this arrangement, crushed or cubed ice can be accessed without being delivered through refrigerator door 128. Rather, ice is accessed by opening refrigerator door 128 and directly accessing ice-dispensing assembly 110 through cover 232 or discharge opening 162. In one embodiment, ice-storage container 160 tilts down to a predetermined angle facilitating accessing ice from ice-storage container 160.

To facilitate maintaining a temperature to produce and store ice, cool air is supplied by sealed cooling system 210 to insulated housing 142. In the exemplary embodiment, dedicated evaporator 220 of sealed cooling system 210 is in fluid flow communication with insulated housing 142 to provide a temperature in insulated housing 142 for producing ice. To increase heat transfer efficiency, an icebox fan 242 is positioned adjacent evaporator 220. In addition, a series of ducts (not shown) are provided between evaporator 220 and insulated housing 142, and the ducts are defined in the insulative material surrounding the sealed cooling system 210 and insulated housing 142. For example, an inlet 244 and a return 246 are formed between sealed cooling system 210 and insulated housing 142 such that cool airflow is forced by icebox fan 242 into insulated housing 142 through inlet 244 and airflow is forced out of insulated housing 142 through return 244.

In the exemplary embodiment, a first temperature sensor 248 is arranged within insulated housing 142 to monitor the temperature in the interior of insulated housing 142. A heater 250 is positioned adjacent to dedicated evaporator 220, to periodically remove frost produced on the surface of dedicated evaporator 220 or within insulated housing 142 during the operation of refrigerator 100.

Figure 5:
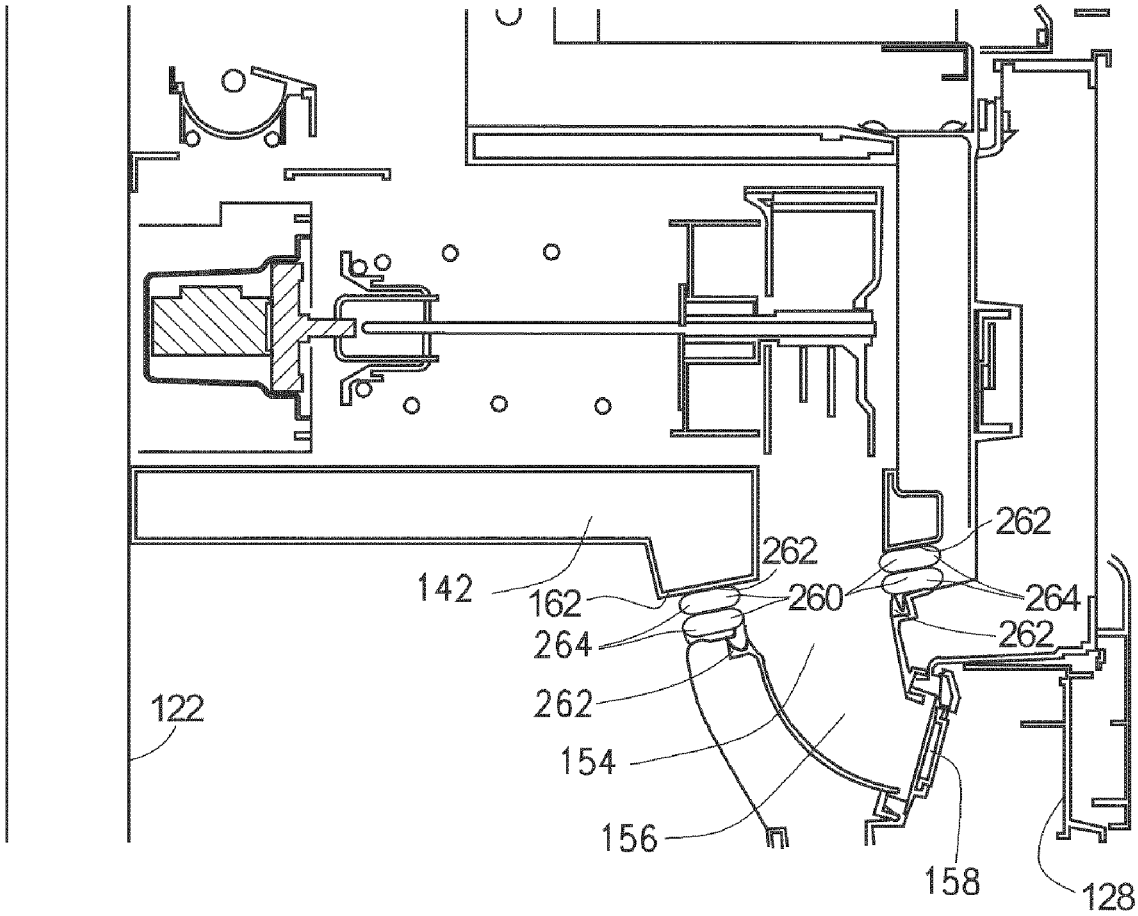
FIG. 5 is a schematic view of exemplary sealing gaskets for use with the insulated housing and the door shown in FIG. 2.

FIG. 5 is a schematic view of a portion of refrigerator compartment 122, insulated housing 142 and door 128 to illustrate the exemplary sealing gaskets 260 used with insulated housing 142 and door 128 shown in FIG. 2. One gasket 260 is coupled to door 128 proximate ice chute inlet 154, and another gasket 260 is couple to insulated housing 142. Gaskets 260 are fabricated from a rubber material. Gaskets 260 facilitate sealing between insulated housing 142 and door 128 when door 128 is in the closed position. Specifically, in the exemplary embodiment, gaskets 260 seal to the portion of insulated housing 142 surrounding discharge opening 162. Each gasket 260 has a mounting portion 262 coupled to either door 128 or insulated housing 142 and a flexible bulb 264 extending from mounting portion 262. When door 128 is closed, flexible bulbs 264 are compressed against one another. As a result, a seal is formed that restricts airflow between insulted housing 142 and refrigerator compartment 122. Alternatively, a single gasket 260 may be used. For example, one gasket 260 could be coupled to door 128 and could compress against insulated housing 142 when door 128 is closed.

Figure 6:
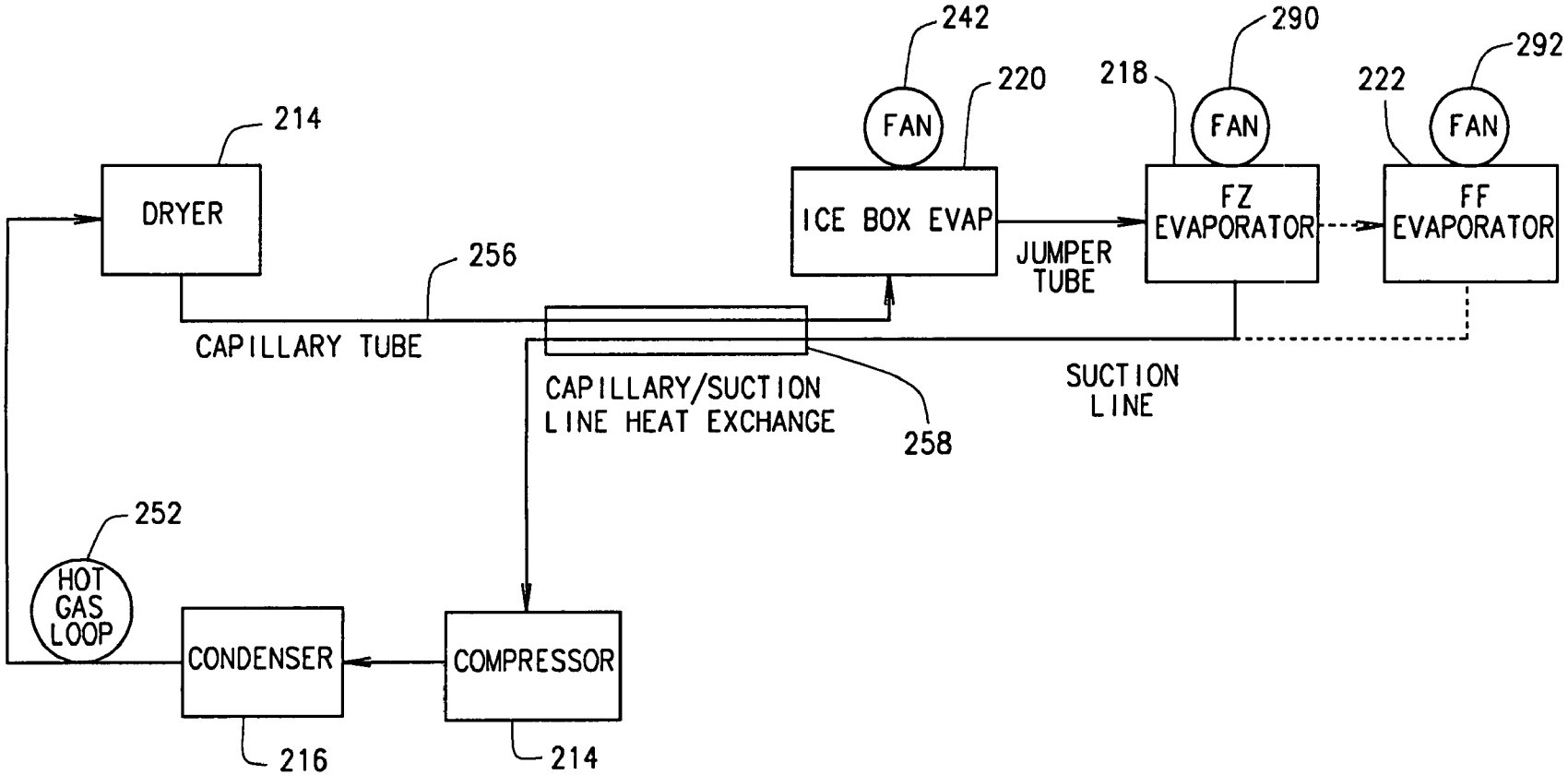
FIG. 6 is a schematic view of an exemplary cooling system for the refrigerator shown in FIG. 1.

FIG. 6 is a schematic view of cooling system 210. In the exemplary embodiment, cooling system 210 includes compressor 214, condenser 216, hot gas loop 252 and a dryer 254. Cooling system 210 also includes dedicated evaporator 220 and freezer evaporator 218. Alternatively, the cooling system could include a fresh food evaporator 222 (shown in phantom in FIG. 6) for cooling refrigerator compartment 122. Evaporators 218, 220 and/or 222 operate in series with one another. Alternatively, evaporators 218, 220 and/or 222 could be arranged to operate in parallel with one another. The various components are coupled to one another via capillary tubes 256. A suction line separates the downstream evaporator 218, 220 and/or 222 and compressor 214. In the exemplary embodiment, a heat exchanger 258 is coupled between suction line 258 and a portion of capillary tube 256.

In the exemplary embodiment, a freezer fan 290 is provided to force air across freezer evaporator 218, compressor 214 and/or condenser 216 to enhance heat transfer into ambient air. A refrigerator fan 292 is also provided to force air across fresh food evaporator 222 and icebox fan 242 is provided to force air across evaporator 220. Collectively, the vapor compression cycle components, associated fans, and associated components operate to force cold air into compartments 122, 124, and 140.

Figure 7:
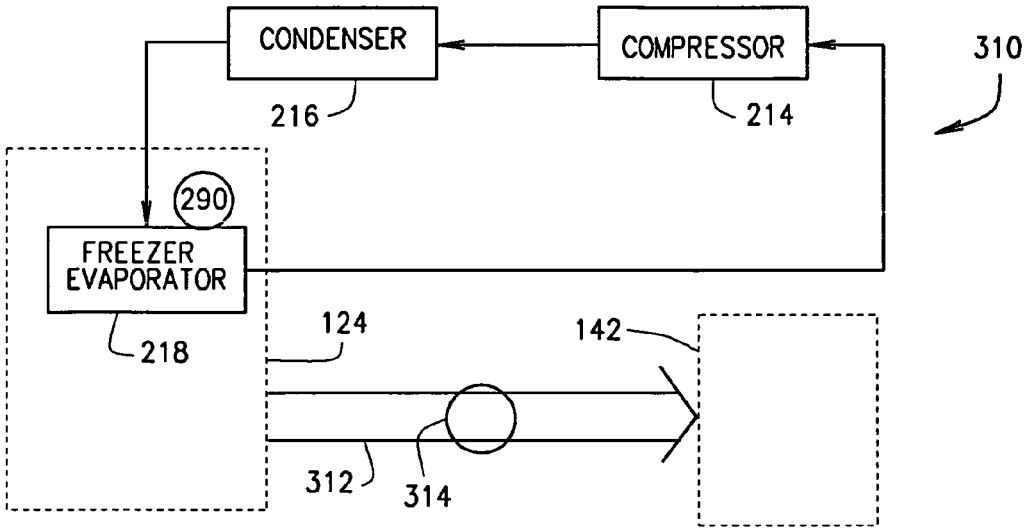
FIG. 7 is a schematic view of an alternative cooling system for the refrigerator shown in FIG. 1.

FIG. 7 is a schematic view of an alternative sealed cooling system 310 having substantially the same components as cooling system 210 (shown in FIG. 4) except that cooling system 310 only includes a single freezer evaporator. In this alternative arrangement, a cooling duct 312 extends between insulated housing 142 and freezer compartment 124. Cooling air from freezer compartment 124 is channeled to insulated housing 142 via cooling duct 312, thus cooling insulated housing 142 to a predetermined temperature. A cooling duct fan 314 is coupled to cooling duct 312 to channel air therethrough. Additionally, a secondary cooling duct (not shown) extends between freezer compartment 124 and refrigerator compartment 122 such that cold air from freezer compartment 124 is channeled into refrigerator compartment 122 for cooling refrigerator compartment 122. In yet another alternative arrangement the cooling air for the refrigerator compartment 122 could be provided via a cooling duct from the insulated housing 142.

Figure 8:
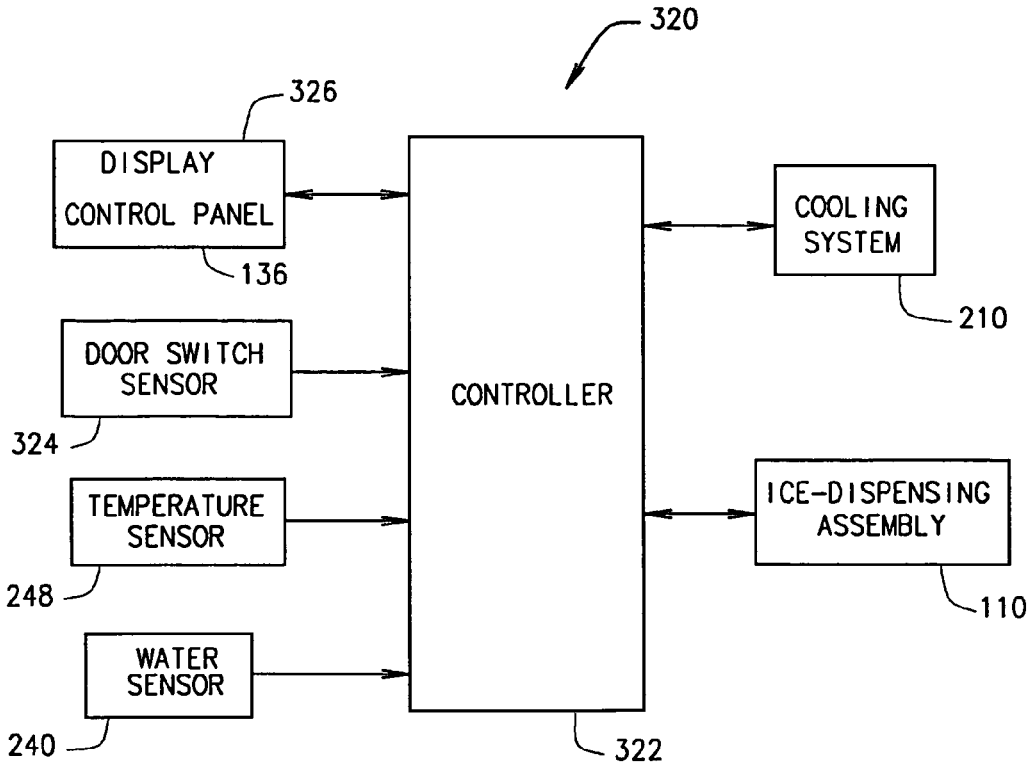
FIG. 8 is schematic view of an exemplary control system applicable to the refrigerator shown in FIG. 1.

FIG. 8 is a schematic view of a control system 320 applicable to refrigerator 100 (shown in FIG. 1). Control system 320 includes a controller 322, such as a microprocessor, for controlling the operation of refrigerator 100 by directing energy to the various electrical components of refrigerator 100. Controller includes software for controlling the components. Controller 322 receives signals from inputs such as, for example, control panel 136, water sensor 240, a door switch sensor 324 for determining when a door such as refrigerator door 128 is open, and temperature sensor 248, for determining the temperature in insulated housing 142 (shown in FIG. 4) and fresh food and freezer temperature sensors positioned within the refrigerator and freezer compartments respectively, of refrigerator 100. Controller 322 could also receives signals from other inputs associated with refrigerator 100. Moreover, controller 322 is operatively coupled to the cooling system 210 and ice-dispensing assembly 110, whereby, certain functions are performed in response to signals received from these inputs.

In the exemplary embodiment, controller 322 operates cooling system 210 based on inputs from control panel 136. Specifically, control panel 136 includes a user operable interface and display 326 for receiving inputs from and displaying data to a user. For example, a user selects an operating temperature or related setting for freezer compartment 124, refrigerator compartment 122 and/or insulated housing 142. Such setting is displayed on control panel 136. Additionally, such input is transmitted to controller 322 and controller 322 operates cooling system 210 to achieve the selected temperature within the various compartments 124, 122 and/or insulated housing 142.

In the exemplary embodiment, controller 322 operates cooling system 210 and ice-dispensing assembly 110 based on inputs from water sensor 240. Specifically, water sensor 240 senses each water fill to ice maker 230. Fan 242 (shown in FIG. 4) is operated within insulated housing 142 to reduce the humidity in insulated housing 142. Additionally, compressor 214, condenser 216 and evaporator 220 are operated to cool insulated housing 142 in response to a water fill. Moreover, a defrost cycle for insulated housing 142 is initiated in response to a predetermined number of water fills. Additionally, controller 322 operates ice-dispensing assembly 110, and particularly, ice maker 230, upon each water fill sensed by water sensor 240.

In the exemplary embodiment, controller 322 operates cooling system 210 and/or ice-dispensing assembly 110 based on inputs from door switch sensor 324. Specifically, when door switch sensor 324 determines that a door, such as refrigerator door 128, is in the open position, controller 322 changes the mode of operation of cooling system 210. For example, cooling system 210 ceases operation in response to refrigerator door 128 being in the open position. Alternatively, cooling system 210 operates in a power save mode when refrigerator door 128 is open. In the exemplary embodiment, controller 322 changes the mode of operation of ice-dispensing assembly 110 when door switch sensor 324 determines that refrigerator door 128 is in the open position. For example, controller 322 operates icebox fan 242 in response to refrigerator door 128 being in the open position, such that a positive pressure is maintained in insulated housing 142 to reduce airflow between insulated housing 142 and refrigerator compartment 122. Additionally, ice making and/or ice dispensing from ice-dispensing assembly 110 cease when refrigerator door 128 is open.

In the exemplary embodiment, controller 322 operates cooling system 210 and/or ice-dispensing assembly 110 based on inputs from temperature sensor 248 (illustrated in FIG. 4 as being located in insulated housing 142). However, in the exemplary embodiment, refrigerator 100 includes temperature sensors 248*a*, 248*b* and 248*c* located in freezer compartment 124, refrigerator compartment 122 and insulated housing 142, respectively. When temperature sensor 248*c* determines that a temperature in insulated housing 142 is above a preset temperature, controller 322 changes the mode of operation of cooling system 210. For example, controller 322 activates cooling system 210, including dedicated evaporator 220, when the temperature is above a preset temperature. Additionally, when temperature sensor 248*b* determines that a temperature in refrigerator compartment 122 is below a preset temperature, such as, for example, a temperature at approximately a freezing temperature, controller 322 changes the mode of operation of cooling system 210. For example, controller 322 de-activates fresh food evaporator 222 when the temperature is below a preset temperature. Cooling system 210 restricts cooling flow to refrigerator compartment 122, such as, for example, by closing a damper (not shown) in the duct from the freezer evaporator to the refrigerator compartment, shutting off the refrigerator compartment fan (not shown), or in the embodiment in which cooling air from housing 142 is used to cool the refrigerator compartment, closing a damper in the duct or opening between insulated housing 142 and refrigerator compartment 122. Additionally, when temperature sensor 248 determines that a temperature in freezer compartment 124 is above a preset temperature, controller 322 changes the mode of operation of cooling system 210. For example, controller 322 activates cooling system 210, including freezer evaporator 218, when the temperature is above a preset temperature. Additionally, controller 322 changes the mode of operation of ice-dispensing assembly 110 when temperature sensor 248 determines that the temperature in insulated housing 142 is above a predetermined temperature. For example, controller 322 de-activates ice maker 230 in response to the temperature in insulated housing 142.

Refrigerator 100 also includes a defrosting mode. Defrost mode is initiated based on inputs received from water sensor 240, door switch sensor 324 and/or temperature sensor 248. For example, once the ice maker 230 has been filled a predetermined number of times, controller 322 initiates the defrost operation. Specifically, water sensor 240 records the number of water fills by either incrementing or decrementing a counter for each water fill until the counter reaches a predetermined threshold amount, at which time, controller 322 initiates a defrost. Additionally, once the refrigerator door 128 has been opened a predetermined number of times, controller 322 starts the defrost operation. Thus, door switch sensor 324 records the number of door opening by either incrementing or decrementing each door opening until the given number of door openings has been reached. In the exemplary embodiment, controller 322 also operates defrosting mode based upon a predetermined time lapse, such that a defrost cycle is initiated after a predetermined amount of time has passed. Additionally, each door opening and each water fill reduces the amount of time remaining until the next defrost cycle by predetermined increments. The defrost cycles of each of freezer evaporator 218 and dedicated evaporator 220 are individually controlled by controller 322. For example, because ice-dispensing assembly 110 is contained within the generally warmer environment of refrigerator compartment 122, as compared to freezer compartment 124, and because the water fills required by the ice-dispensing assembly 110 creates a higher humidity level due to the increased door openings, dedicated evaporator 220 may benefit from defrosting more often than freezer evaporator 218.

Figure 9:
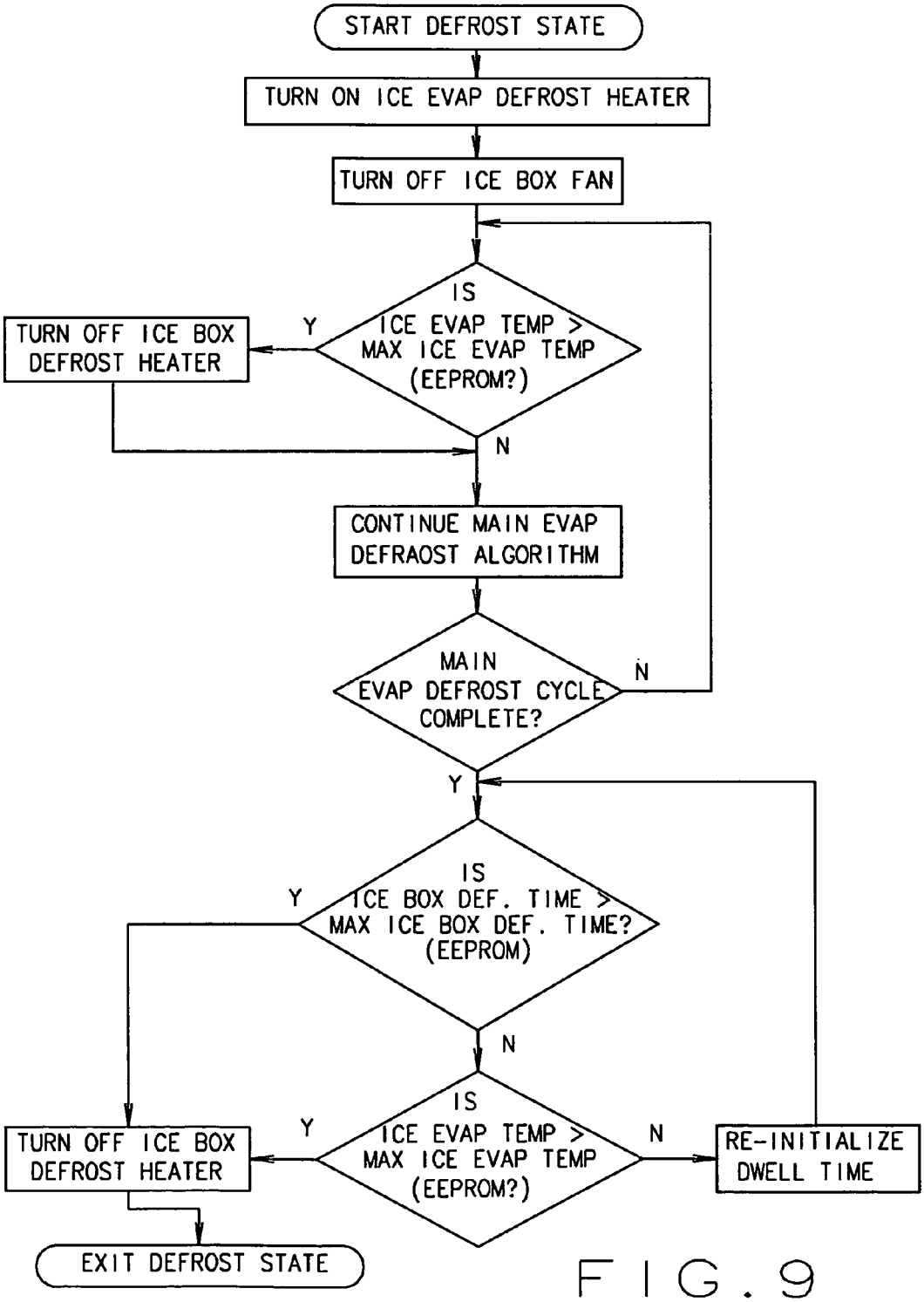
FIG. 9 is a flow chart illustrating an exemplary function of the control system illustrated in FIG. 10.

FIG. 9 is a flow chart illustrating an exemplary function of control system 320 illustrated in FIG. 8. Specifically, FIG. 9 illustrates an exemplary defrost algorithm 350 for controller 322 operating refrigerator 100 in a main defrost state or mode of operation wherein both freezer evaporator 218 and dedicated evaporator 220 are defrosted. Once defrost mode is initiated 352, as determined by the inputs to controller 322, heaters 224 are turned on 354 and airflow to the compartments is restricted such as, for example, by turning off 356 fans 290, 292 and/or 242 directing airflow to the compartments. Heaters 224 are used to defrost at least some of cooling system 210 and ice dispensing assembly 110 components, such as, for example, compressor 214, condenser 216, freezer evaporator 218 and/or dedicated evaporator 220.

In operation, the temperature of freezer evaporator 218 is determined 358. If the temperature is greater than a predetermined temperature indicative of ice having been sufficiently removed from the coils of the evaporator, freezer evaporator heater 224 is turned off 360. If the temperature of evaporator 218 is less than the maximum temperature, evaporator defrost algorithm continues 362. Additionally, the freezer evaporator 218 defrost cycle is continued until the defrost cycle is completed. For example, the freezer evaporator 218 defrost cycle is continued for a predetermined amount of time or until evaporator 218 reaches a predetermined temperature.

When the freezer evaporator 218 defrost cycle is completed, the defrost time of ice dispensing assembly 110 is determined 364. If the defrost time is greater than a maximum defrost time, the dedicated evaporator heater 224 is turned off 366 and the defrost state is completed 368. If the defrost time is less than the maximum defrost time, the defrosting continues. Additionally, throughout the defrost cycles, dedicated evaporator 220 temperature is monitored 370 in order to prevent damage, such as melting, to insulated housing 142 or other components in refrigerator 100. If the evaporator 220 temperature is greater than a predetermined temperature, the heater 224 is turned off 366 and the defrost state is completed 368. If the evaporator 220 temperature is below the maximum temperature a dwell time is initiated 372 and the defrost cycle continues until the evaporator 220 temperature is greater than the predetermined temperature.

In one embodiment, when the defrost state is completed, icebox fan 242 remains turned off until the temperature of freezer evaporator 218 and/or dedicated evaporator 220 cool to a predetermined temperature. However, this condition may be overridden if the temperature within insulated housing 142 is above a predetermined temperature to prevent ice melting. Additionally, the defrost cycles are cancelled if the temperature within freezer compartment 124 and/or insulated housing 142 is above a predetermined temperature to prevent melting. In one embodiment, an ice dispensing assembly 110 defrost cycle is initiated without initiating a freezer evaporator 218 defrost cycle, depending on the inputs received at controller 322.

Figure 10:
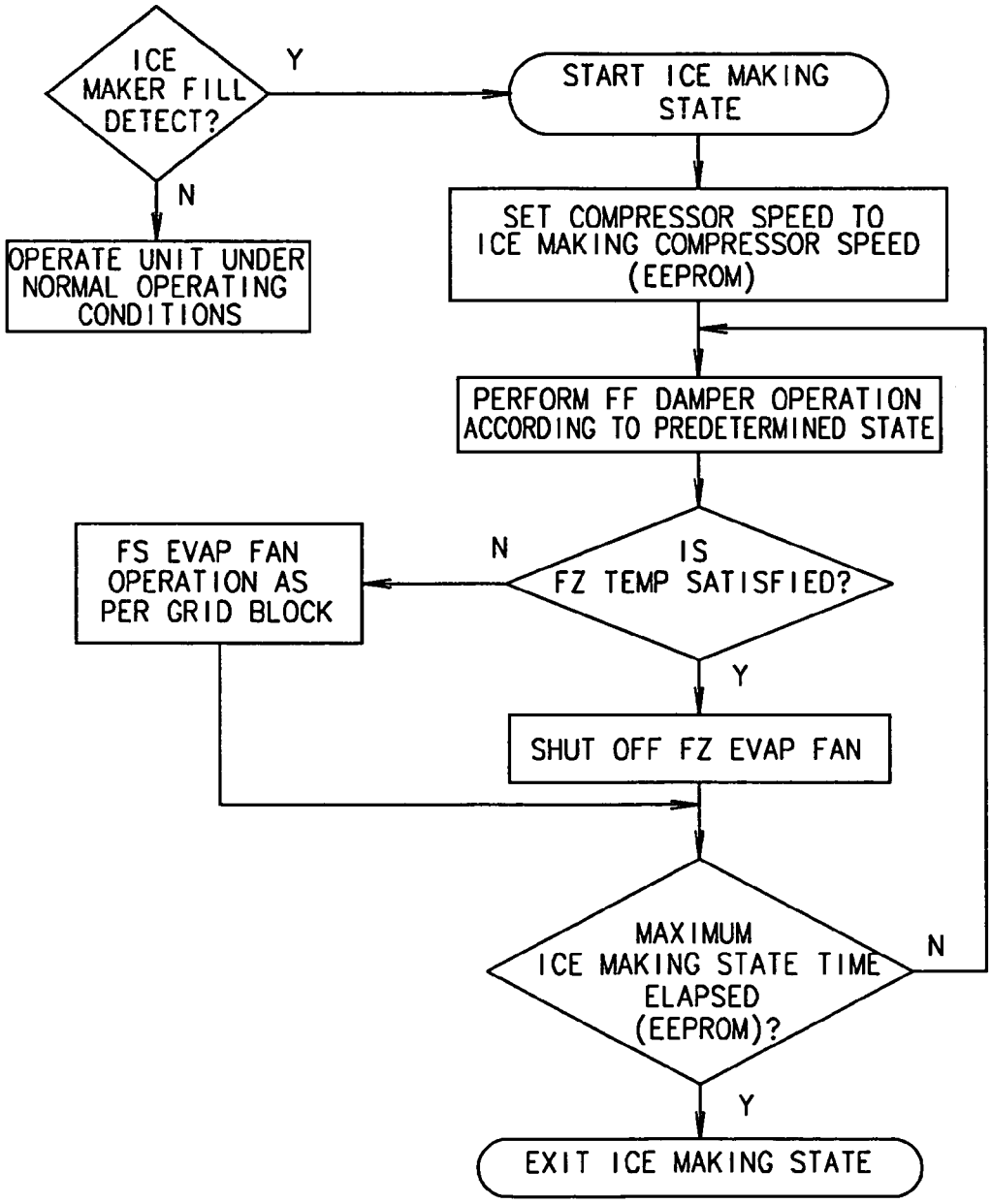
FIG. 10 is a flow chart illustrating an exemplary function of the control system illustrated in FIG. 10.

FIG. 10 is a flow chart illustrating an exemplary function of control system 320 illustrated in FIG. 8. Specifically, FIG. 10 illustrates an exemplary ice making algorithm 380 for controller 322 operating refrigerator 100 in an ice making state or mode of operation wherein controller 322 enters an ice making state whenever an ice maker fill is detected by water sensor 240.

In operation, refrigerator 100 is operated 382 under normal operating conditions until an ice maker fill is detected 384, wherein ice maker 230 is operated and ice making state is initiated 386. Compressor 214 is a variable speed compressor and the speed is set 388 to a predetermined ice making compressor speed during the ice making state. In the exemplary embodiment, the ice making compressor speed is a maximum compressor speed. During the ice making state, compressor 214 is operated and icebox fan 242 is operated to cool ice dispensing assembly 110 and to facilitate making ice. For example, compressor 214 is operated when the ice making state is initiated, and is operated for a predetermined amount of time after the ice making state is ceased. In the exemplary embodiment, compressor 214 is operated for approximately two hours after the ice making state is ceased.

During the ice making state, the temperatures of fresh food compartment 122 and freezer compartment 124 are monitored. When cooling in either compartment 122 or 124 is demanded, cooling system 210 is operated to cool compartments 122 or 124. In the exemplary embodiment, during the ice making state, a FF damper operation is performed 390 according to a predetermined state. For example, when cooling is demanded in fresh food compartment 122, the FF damper is opened to allow cooling airflow from a cooling source such as, for example, freezer compartment 124, insulated housing 142, or a dedicated fresh food evaporator 222, depending on the configuration of refrigerator 100.

During the ice making state, the temperature of freezer compartment 124 is determined 392. If the temperature is below a predetermined temperature, freezer evaporator fan 290 is shut off 394. If the temperature is above a predetermined temperature, freezer evaporator fan 290 is operated 396 to cool freezer compartment 124. As such, during the ice making state, the control system independently monitors the temperature of freezer compartment 124 and operates cooling system 210 based on the temperature of freezer compartment 124.

During the ice making state, the time refrigerator 100 is in the ice making state is determined 398. Until a predetermined amount of time has elapsed, the temperatures of fresh food compartment 122 and freezer compartment 124 are monitored and controlled. When the maximum time of ice-making elapses, the ice-making process is ended 400 and refrigerator 100 is operated under normal operating conditions. Alternatively, refrigerator 100 is operated in another ice making state, or in a defrost state. In another alternative, refrigerator 100 is operated in an ice maintenance state.

Figure 11:
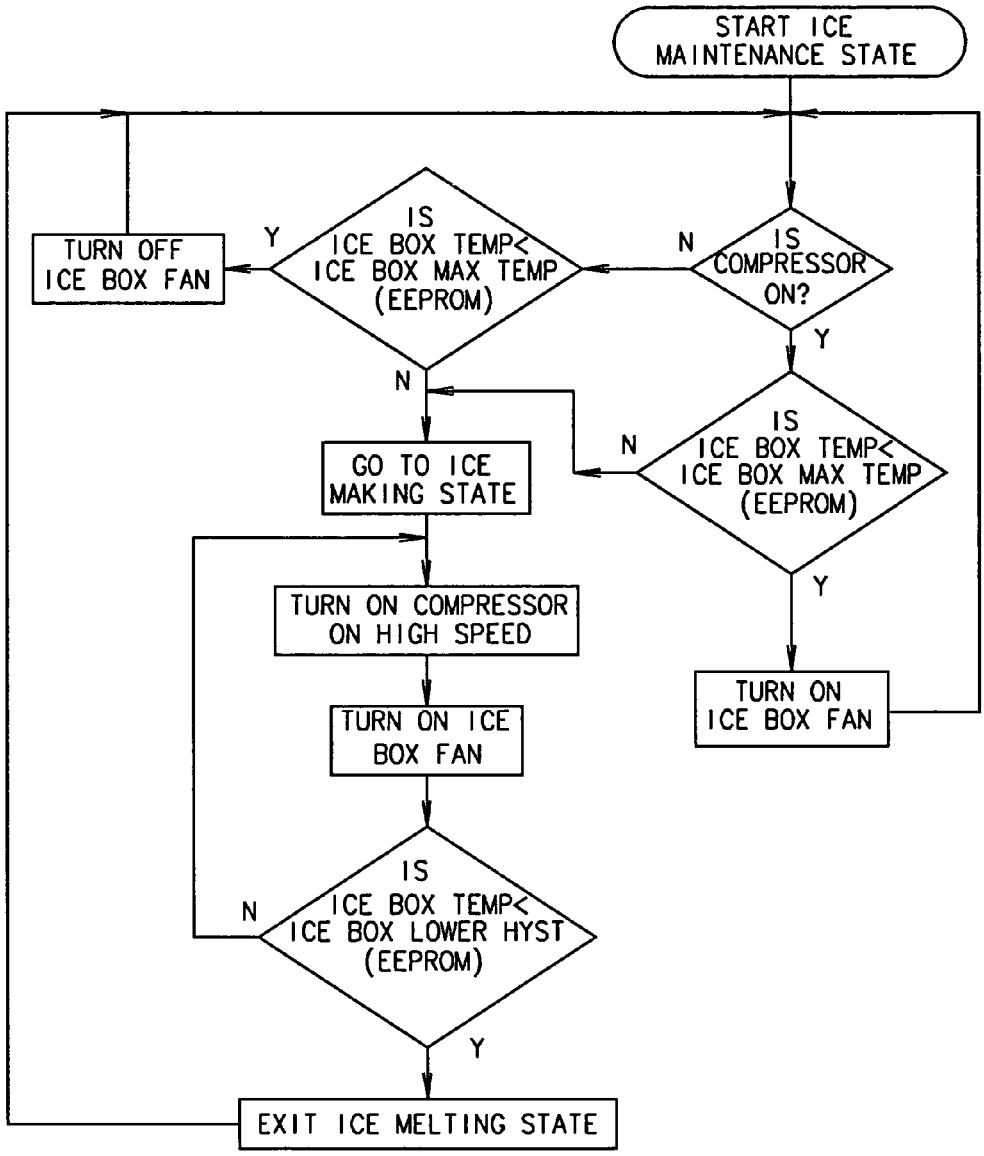
FIG. 11 is a flow chart illustrating an exemplary function of the control system illustrated in FIG. 10.

FIG. 11 is a flow chart illustrating an exemplary function of control system 320 illustrated in FIG. 8. Specifically, FIG. 11 illustrates an exemplary ice maintenance algorithm 410 for controller 322 operating refrigerator 100 in an ice maintenance state or mode of operation.

Once the ice maintenance state is initiated 412, the ice maintenance process controls an operation of compressor 214 and/or icebox fan 242. Specifically, the ice maintenance process operates compressor 214 and/or icebox fan 242 until the temperature in insulated housing 142 is below a predetermined maximum temperature, thus cooling insulating housing 142 to maintain the ice. The operational state of the compressor 214 is determined 414 and the temperature in insulated housing 214 is determined 416. For example, if compressor 214 is on, and the temperature in insulated housing 142 is less than a predetermined maximum temperature, icebox fan 242 is then turned off 418. The process continues to determine if the compressor 214 is on and if the temperature is less than the predetermined maximum temperature. However, when the temperature in insulated housing 142 is above the predetermined maximum temperature, the ice maintenance process is directed 420 to an ice melting prevention process.

In the exemplary embodiment, when the ice maintenance process is initiated, if the compressor 214 is off, the system determines 422 the temperature of the insulated housing 142. If the temperature in insulated housing 142 is less than the predetermined maximum temperature, then the icebox fan 242 is turned off 424. The process continues until the temperature is above the predetermined maximum temperature, and then, the ice maintenance process is directed 420 to an ice melting process.

In the ice melting prevention state, the cooling system is operated to rapidly restore the temperature in insulated housing 142 to within the desired temperature range. To that end, the compressor is turned on 426 to a maximum compressor speed. The icebox fan 242 is turned on 428, and the temperature of the insulated housing 142 is monitored 430. If the temperature in insulated housing 142 is greater than a predetermined upper hysteresis value, then the ice melting prevention state is continued. When the temperature in insulated housing 142 drops below a lower hysteresis value, the ice melting state is exited 432, and the ice maintenance state is continued.

Figure 12:
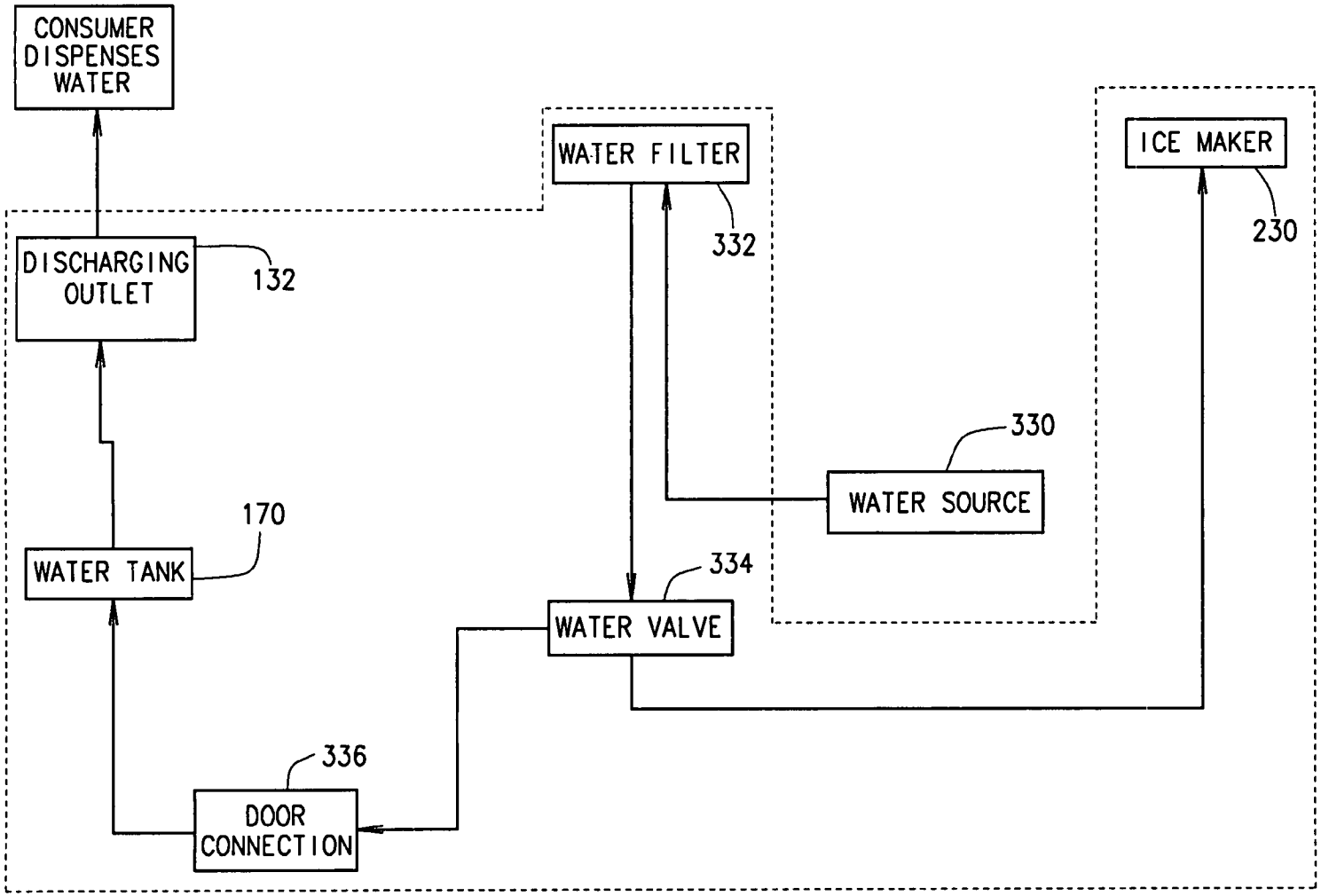
FIG. 12 is a schematic view of an exemplary water line configuration of the refrigerator shown in FIG. 1.

FIG. 12 is a schematic view of an exemplary water line configuration of refrigerator 100 shown in FIG. 1. As shown in FIG. 12, after water flows from a water source 330, the water continues flowing through a filter 332 to be purified. A water valve 334 controls the flow of water from filter 332 to ice maker 230 and discharging outlet 132. In an exemplary embodiment, water dispensed to the consumer through discharging outlet 132 is channeled from water valve 334 through a door connection 336 into water tank 170 received in the door of the refrigerator. Upon demand by the consumer the water is channeled from water tank 170 through discharging outlet 132.

Figure 13:
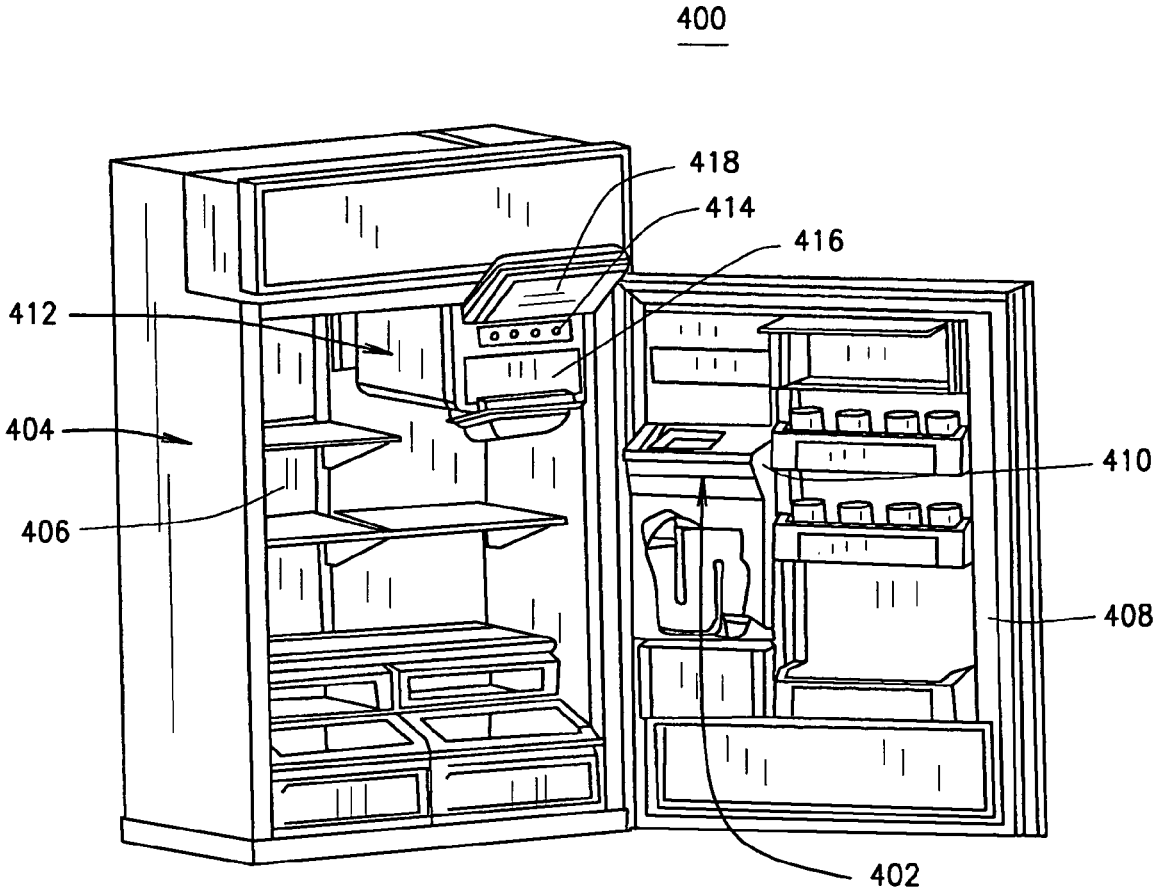
FIG. 13 is a perspective view of an alternative refrigerator having a refrigerator door in an open position.

FIG. 13 is a perspective view of an alternative refrigerator 400 having a refrigerator door in an open position. Refrigerator 400 includes ice-dispensing assembly 402 for dispensing water and/or ice. Refrigerator 400 includes a housing 404 defining a single compartment 406. In the exemplary embodiment, compartment 406 is a refrigerated compartment and is operated at a temperature above freezing. A refrigerator door 408 is rotatably hinged to an edge of housing 404 for accessing refrigerator compartment 406.

Ice-dispensing assembly 402 includes a dispenser 410, similar in structure and operation to dispenser 114 (shown in FIG. 1); an insulated housing 412, similar in structure and operation to insulated housing 142 (shown in FIG. 2); an ice-making device 414, similar in structure and operation to an ice maker 230 (shown in FIG. 2); an ice-storage container or bucket 416, similar in structure and operation to ice-storage container or bucket 160 (shown in FIG. 2); and an access door or cover 418 similar in structure and operation to access door or cover 232 (shown in FIG. 2).

While the invention has been described in terms of various specific embodiments, those skilled in the art will recognize that the invention can be practiced with modification within the spirit and scope of the claims.

What is claimed is:

1. An ice-dispensing assembly for a refrigerator having a refrigerator compartment and a door providing access to the refrigerator compartment, said ice-dispensing assembly comprising:

a dispenser mountable on the door within the refrigerator compartment, said dispenser comprising a discharge chute comprising an inlet and a first gasket positioned about said inlet;

an insulated housing mountable within the refrigerator compartment;

an ice-making device arranged within said insulated housing; and an ice-storage container arranged within said insulated housing, said ice-storage container comprising a discharge opening and a second gasket coupled to said ice-storage container and positioned about said discharge opening, said discharge opening oriented to be substantially aligned with said inlet of said discharge chute when said dispenser is mounted on the door and the door is closed such that said second gasket contacts said first gasket to form a seal between said ice-storage container and said discharge chute.

2. An ice-dispensing assembly in accordance with claim 1 wherein said discharge chute comprises an outlet positionable in communication with an external portion of the refrigerator, said dispenser further comprising a chute door covering said outlet, said chute door moveable between an open position and a closed position.

3. An ice-dispensing assembly in accordance with claim 1 wherein said ice-storage container comprises:

an auger system configured to deliver ice to said dispenser; and a crusher mechanism configured to crush ice prior to being delivered to said dispenser.

4. An ice-dispensing assembly in accordance with claim 1 wherein said insulated housing comprises an access door for accessing said ice-storage container, said access door configured to substantially seal airflow between said insulated housing and the refrigerator compartment.

5. An ice-dispensing assembly in accordance with claim 1 further comprising:

an evaporator received in said insulated housing; and a temperature sensor arranged within said insulated housing.

6. An ice-dispensing assembly in accordance with claim 1 wherein the refrigerator further includes a freezer compartment, said ice-dispensing assembly further comprising a duct sized to extend between said insulated housing and the freezer compartment such that cold air from the freezer compartment is channeled through said duct to cool said insulated housing.

7. An ice-dispensing assembly in accordance with claim 1 further comprising a controller configured to control said ice-making device via inputs from one of a door switch sensor and a water fill device.

8. A refrigerator comprising:

a refrigerator body comprising a refrigerator compartment;

a door for accessing said refrigerator compartment; and an ice-dispensing assembly mounted within said refrigerator compartment, said ice-dispensing assembly comprising:

a dispenser mounted on said door, said dispenser comprising a discharge chute comprising an inlet and a first gasket positioned about said inlet;

an insulated housing mounted within said refrigerator compartment;

an ice-making device arranged within said insulated housing; and an ice-storage container arranged within said insulated housing, said ice-storage container comprising a discharge opening and a second gasket coupled to said ice-storage container and positioned about said discharge opening, said discharge opening oriented to be substantially aligned with said inlet of said discharge chute when said door is closed such that said second gasket contacts said first gasket to form a seal between said ice-storage container and said discharge chute.

9. A refrigerator in accordance with claim 8 wherein said refrigerator body further comprises at least one freezer compartment arranged at a bottom portion of said refrigerator body, said refrigerator compartment arranged above said at least one freezer compartment.

10. A refrigerator in accordance with claim 8 wherein said refrigerator body further comprises at least one freezer compartment arranged in a side-by-side arrangement with respect to said refrigerator compartment.

11. A refrigerator in accordance with claim 8 wherein said ice-storage container comprises:

an auger system configured to deliver ice to said dispenser; and a crusher mechanism configured to crush ice prior to being delivered to said dispenser.

12. A refrigerator in accordance with claim 8 wherein said discharge chute comprises an outlet in communication with an external portion of said refrigerator, and said dispenser comprises a chute door covering said outlet, said chute door moveable between an open position and a closed position to facilitate passing ice through said outlet.

13. A refrigerator in accordance with claim 8 further comprising:

an evaporator received in said insulated housing; and a temperature sensor arranged within said insulated housing.

14. A refrigerator in accordance with claim 8 wherein said refrigerator body further comprises a freezer compartment, said refrigerator further comprising a first evaporator dedicated to said freezer compartment, a second evaporator dedicated to said refrigerator compartment, and a third evaporator dedicated to said ice-dispensing assembly.

15. A refrigerator in accordance with claim 8 wherein said refrigerator body further comprises a freezer compartment, said refrigerator further comprising at least one duct, said at least one duct extending between said freezer compartment and one of said insulated housing and said refrigerator compartment, wherein cold air from said freezer compartment is channeled through said at least one duct to cool one of said insulated housing and said refrigerator compartment.

16. A refrigerator in accordance with claim 8 wherein said insulated housing comprises an access door for accessing said ice-storage container, said access door configured to seal said insulated housing and said refrigerator compartment when said access door is in a closed position.

17. A refrigerator in accordance with claim 8 further comprising a water dispenser arranged within said refrigerator compartment door.

18. A refrigerator in accordance with claim 8 further comprising a control panel arranged on an inside of said refrigerator compartment door.

* * * * *